US010152021B2

(12) United States Patent
Matsumoto et al.

(10) Patent No.: US 10,152,021 B2
(45) Date of Patent: Dec. 11, 2018

(54) CARTRIDGE THAT REDUCES CONTACT WITH PHOTOSENSITIVE MEMBER

(71) Applicant: CANON KABUSHIKI KAISHA, Tokyo (JP)

(72) Inventors: Kazuki Matsumoto, Fuji (JP); Osamu Anan, Susono (JP); Hiroki Shimizu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/586,025

(22) Filed: May 3, 2017

(65) Prior Publication Data

US 2017/0329278 A1 Nov. 16, 2017

(30) Foreign Application Priority Data

May 11, 2016 (JP) ..... 2016-095013
Feb. 27, 2017 (JP) ..... 2017-034481

(51) Int. Cl.
*G03G 21/18* (2006.01)

(52) U.S. Cl.
CPC ..... *G03G 21/1814* (2013.01)

(58) Field of Classification Search
CPC ..... G03G 21/1814
See application file for complete search history.

(56) References Cited

U.S. PATENT DOCUMENTS 5,887,232 A * 3/1999 Phillips ..... G03G 15/0884 222/DIG. 1
2005/0169664 A1* 8/2005 Arimitsu ..... G03G 21/1832 399/111
2013/0259494 A1* 10/2013 Hamaya ..... G03G 21/1832 399/9

FOREIGN PATENT DOCUMENTS

JP H07181871 A 7/1995
JP H0863081 A 3/1996
JP 2000029368 A 1/2000
JP 2003173076 A 6/2003

* cited by examiner

*Primary Examiner* — Victor Verbitsky
(74) *Attorney, Agent, or Firm* — Canon U.S.A., Inc. IP Division

(57) ABSTRACT

A cartridge attachable to and detachable from a main body of an image forming apparatus includes a frame. A photosensitive member is rotatably supported by the frame. An opening is provided in the frame that exposes the photosensitive member. A cover member is detachably attached to the frame to cover at least part of the opening. A flexible sheet member having handling caution information displayed thereon is attached to the cover member on one end portion thereof and separably attached to the frame on the other end portion thereof.

19 Claims, 12 Drawing Sheets

CARTRIDGE THAT REDUCES CONTACT WITH PHOTOSENSITIVE MEMBER

BACKGROUND OF THE INVENTION

Field of the Invention

The disclosure relates to a cartridge detachably mounted to a main body of an image forming apparatus, such as a copier, a printer, or a facsimile machine.

Description of the Related Art

Image forming apparatuses that form an image on a recording material using an electrophotographic image forming method (electrophotographic process) are known. Examples of the image forming apparatuses include copiers and laser beam printers.

In an image forming apparatus using an electrophotographic image forming method, an electrophotographic photosensitive member (hereinafter simply referred to as "photosensitive member") serving as an image bearing member is uniformly charged. Then, the charged photosensitive member is selectively exposed to light to form an electrostatic latent image on the photosensitive member. Next, a developer (toner) is supplied onto the electrostatic latent image on the photosensitive member to visualize it into a toner image. Then, the toner image formed on the photosensitive member is transferred onto a recording material, such as a recording sheet or plastic sheet. By applying heat and pressure to the toner image on the recording material, the toner image is thermally fused and fixed on the recording material.

An image forming apparatus, such as that described above, generally requires maintenance of various image formation processing units. To facilitate the maintenance of the various image formation processing units, a process cartridge is adopted, which is formed by combining a photosensitive member, a charging unit, a developing unit, and a cleaning unit into a frame. The process cartridge is detachably mounted to the main body of the image forming apparatus. With this process cartridge technique, an image forming apparatus with excellent usability can be provided.

In the process cartridge described above, a cleaning frame supports a photosensitive drum, a charging roller for charging the surface of the photosensitive drum, and a cleaning member that scrapes off developer remaining on the surface of the photosensitive drum. The photosensitive drum is rotatably supported by a bearing member on the cleaning frame.

In the process cartridge described above, the surface of the photosensitive drum is partly exposed from an opening in the frame. As a result, the user may touch the surface of the photosensitive drum. If the user touches the surface of the photosensitive drum, the resulting adhesion of finger oil or the like to the surface of the photosensitive drum may affect image quality.

To prevent the user from touching the surface of the photosensitive drum, the surface of the photosensitive drum may be covered with a drum cover. The drum cover has the function of protecting the surface of the photosensitive drum from light, dust, and user's touch. To further reduce the risk of the user accidentally touching the surface of the photosensitive drum, Japanese Patent Laid-Open No. 2000-029368 discloses a technique in which a message warning the user not to touch the surface of a photosensitive drum is printed on a flexible sheet member jutting from one edge of an opening in a frame.

The process cartridge may be mounted to the main body of the image forming apparatus after removal of the drum cover covering the surface of the photosensitive drum (photosensitive member). When the process cartridge is mounted on the main body of the image forming apparatus, the surface of the photosensitive drum is partly exposed from the opening in the frame. Therefore, after removal of the drum cover, the user may touch the surface of the photosensitive drum before the process cartridge is inserted into the main body of the image forming apparatus.

With a recent increase in the life of process cartridges, a technique has been proposed in which a drum cartridge including a photosensitive drum and a developing cartridge including a developing device are configured as separate components. The drum cartridge and the developing cartridge can thus be replaced individually. This configuration increases the surface area of the photosensitive drum exposed from the opening in the frame. Accordingly, it is required to provide a configuration that prevents the user from touching the surface of the photosensitive drum.

SUMMARY OF THE INVENTION

An aspect of the disclosure provides a cartridge that reduces user's contact with a photosensitive member.

Specifically, the disclosure provides a cartridge that is attachable to and detachable from a main body of an image forming apparatus and includes a frame; a photosensitive member rotatably supported by the frame; an opening provided in the frame, the opening being configured to expose the photosensitive member; a cover member detachably attached to the frame to cover at least part of the opening; and a flexible sheet member having handling caution information displayed thereon, the sheet member being attached to the cover member on one end portion thereof and separably attached to the frame on the other end portion thereof.

Further features and aspects of the disclosure will become apparent from the following description of the various example embodiments with reference to the attached drawings.

DESCRIPTION OF THE EMBODIMENTS

A process cartridge and an image forming apparatus including the process cartridge according to an example embodiment of the disclosure will now be described with reference to the drawings.

(Image Forming Apparatus)

Figure 1:
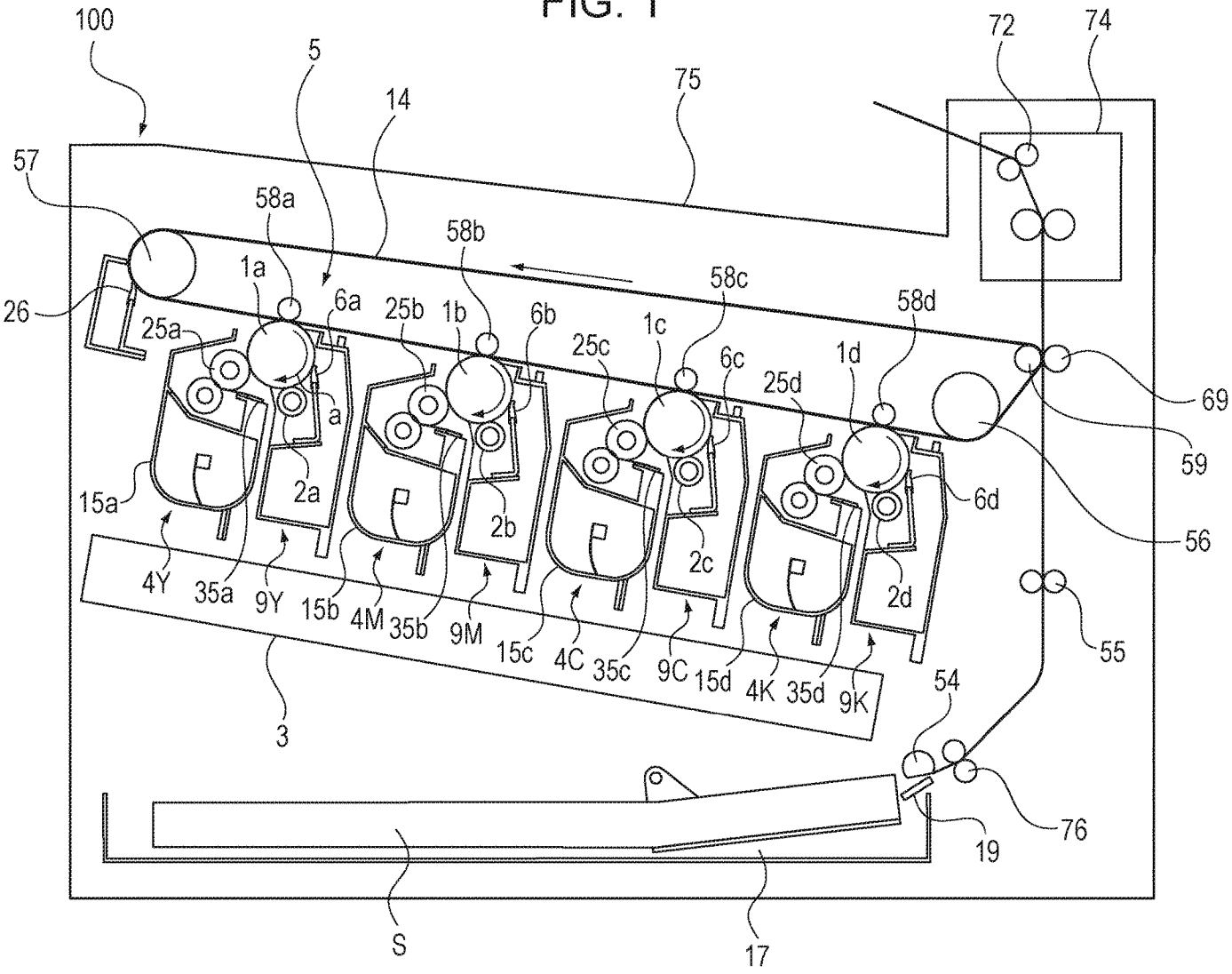
FIG. 1 is a cross-sectional view illustrating a configuration of an image forming apparatus according to an example embodiment of the disclosure.
Figure 2:
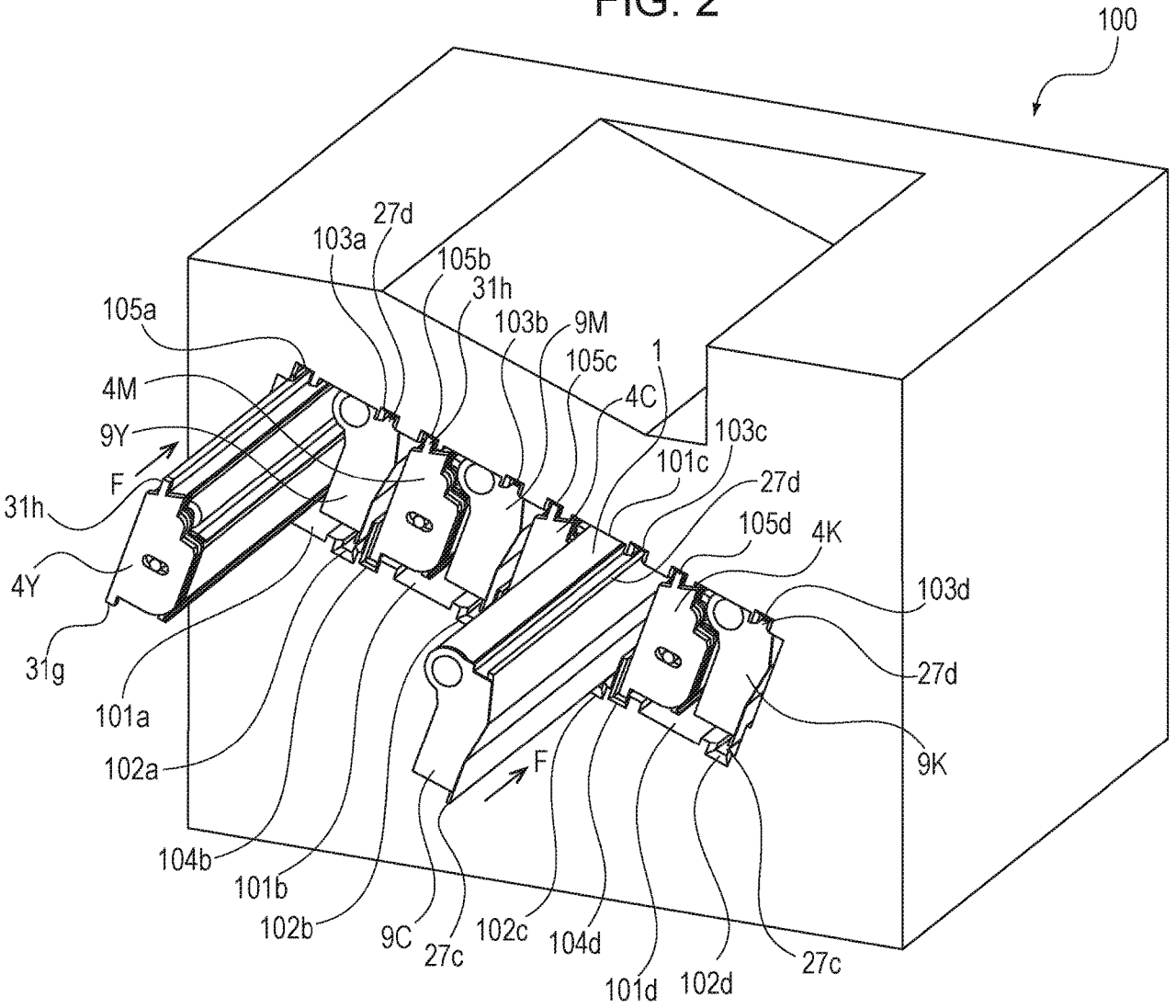
FIG. 2 is a perspective view illustrating how a drum cartridge and a developing cartridge are independently detachably mounted to a main body of the image forming apparatus.

An example configuration of an image forming apparatus 100 in which a process cartridge according to an embodiment of the disclosure is detachably mounted will be described with reference to FIGS. 1 and 2. FIG. 1 is a cross-sectional view illustrating a configuration of the image forming apparatus 100. FIG. 2 is a perspective view illustrating how a drum cartridge and a developing cartridge that form a process cartridge are independently detachably mounted to a main body of the image forming apparatus 100.

As illustrated in FIG. 2, the main body of the image forming apparatus 100 has openings 101*a*, 101*b*, 101*c*, and 101*d*. For convenience in explanation, the term "opening 101" may be used to refer to any of the openings 101*a*, 101*b*, 101*c*, and 101*d*. These openings 101 are arranged along a surface inclined at a predetermined angle with respect to the horizontal surface of the main body of the image forming apparatus 100.

The openings 101 are each internally provided with mount portions for detachably mounting the process cartridge. Specifically, lower guides 102*a*, 102*b*, 102*c*, 102*d*, 104*a*, 104*b*, 104*c*, and 104*d*, each having a groove U-shaped in cross-section, are each provided in the corresponding opening 101. Additionally, upper guides 103*a*, 103*b*, 103*c*, 103*d*, 105*a*, 105*b*, 105*c*, and 105*d*, each having a groove U-shaped in cross-section, are each provided in the corresponding opening 101.

The term "lower guide 102" may be used to refer to any of the lower guides 102*a*, 102*b*, 102*c*, and 102*d*. Each lower guide 102 is positioned, with the open side of its groove U-shaped in cross-section facing substantially upward. The term "upper guide 103" may be used to refer to any of the upper guides 103*a*, 103*b*, 103*c*, and 103*d*. Each upper guide 103 is positioned, with the open side of its groove U-shaped in cross-section facing substantially downward.

The term "lower guide 104" may be used to refer to any of the lower guides 104*a*, 104*b*, 104*c*, and 104*d*. Each lower guide 104 is positioned, with the open side of its groove U-shaped in cross-section facing substantially upward.

For convenience in explanation, the term "drum cartridge 9" may be used to refer to any of drum cartridges 9Y, 9M, 9C, and 9K, each forming a process cartridge, and the term "developing cartridge 4" may be used to refer to any of developing cartridges 4Y, 4M, 4C, and 4K, each forming a process cartridge. The same applies to the other image formation processing units.

Note that the lower guides 104*a* and 104*c* are not shown in FIG. 2, as they are obstructed by the developing cartridge 4Y and the drum cartridge 9C in a pulled-out state. The term "upper guide 105" may be used to refer to any of the upper guides 105*a*, 105*b*, 105*c*, and 105*d*. Each upper guide 105 is positioned, with the open side of its groove U-shaped in cross-section facing substantially downward.

Figure 4:
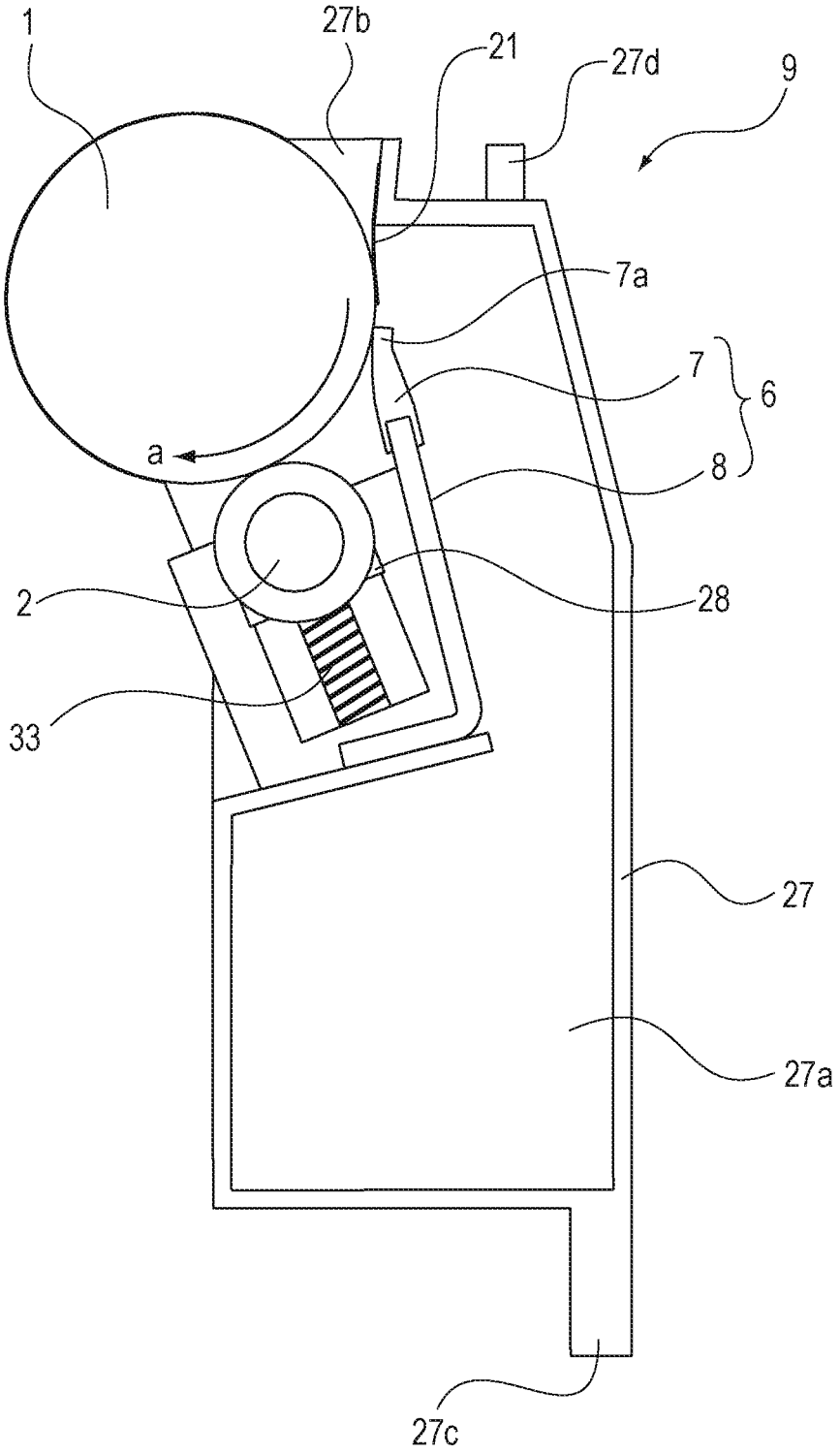
FIG. 4 is a cross-sectional view illustrating an example configuration of the drum cartridge.

As illustrated in FIG. 4, a cleaning frame 27 of each drum cartridge 9 has protrusions 27*c* and 27*d* protruding downward and upward, respectively, from lower and upper ends of the cleaning frame 27. As illustrated in FIG. 2, the protrusion 27*c* of the drum cartridge 9 is slidably engaged in the groove of the lower guide 102 on the front side in the mounting direction, and the protrusion 27*d* of the drum cartridge 9 is slidably engaged in the groove of the upper guide 103 on the front side in the mounting direction. Then, the drum cartridge 9 is moved along the upper guide 103 and the lower guide 102 in the insertion direction indicated by arrow F in FIG. 2. The drum cartridge 9 can thus be inserted and mounted at a predetermined position in the main body of the image forming apparatus 100.

As illustrated in FIG. 2, a developing frame 31 (see FIG. 5) of each developing cartridge 4 has protrusions 31*g* and 31*h* protruding downward and upward, respectively, from lower and upper ends of the developing frame 31. As illustrated in FIG. 2, the protrusion 31*g* of the developing cartridge 4 is slidably engaged in the groove of the lower guide 104 on the front side in the mounting direction, and the protrusion 31*h* of the developing cartridge 4 is slidably engaged in the groove of the upper guide 105 on the front side in the mounting direction. Then, the developing cartridge 4 is moved along the upper guide 105 and the lower guide 104 in the insertion direction indicated by arrow F in FIG. 2. The developing cartridge 4 can thus be inserted and mounted at a predetermined position in the main body of the image forming apparatus 100.

The drum cartridges 9Y, 9M, 9C, and 9K and the developing cartridges 4Y, 4M, 4C, and 4K are thus independently detachably mounted to the main body of the image forming apparatus 100. Photosensitive drums 1*a* to 1*d* (see FIG. 1), each serving as an image bearing member, are rotatably supported by the respective cleaning frames 27 (frames) of the drum cartridges 9. Developing devices 15*a* to 15*d* (see FIG. 1; hereinafter they may be referred to as "developing devices 15"), each serving as a developing unit, are included in the respective developing cartridges 4.

In the image forming apparatus 100 illustrated in FIG. 2, the upstream side in the mounting direction of the drum cartridge 9 and the developing cartridge 4 (i.e., front side in FIG. 2) will be referred to as a front side of the image forming apparatus 100, and the downstream side in the mounting direction of the drum cartridge 9 and the developing cartridge 4 (i.e., back side in FIG. 2) will be referred to as a back side of the image forming apparatus 100.

As illustrated in FIGS. 1 and 2, the four drum cartridges 9 and the four developing cartridges 4 are arranged side by side along the surface inclined at a predetermined angle with respect to the horizontal surface of the main body of the image forming apparatus 100. The drum cartridges 9 and the developing cartridges 4 are each horizontal in the longitudinal direction.

Figure 5:
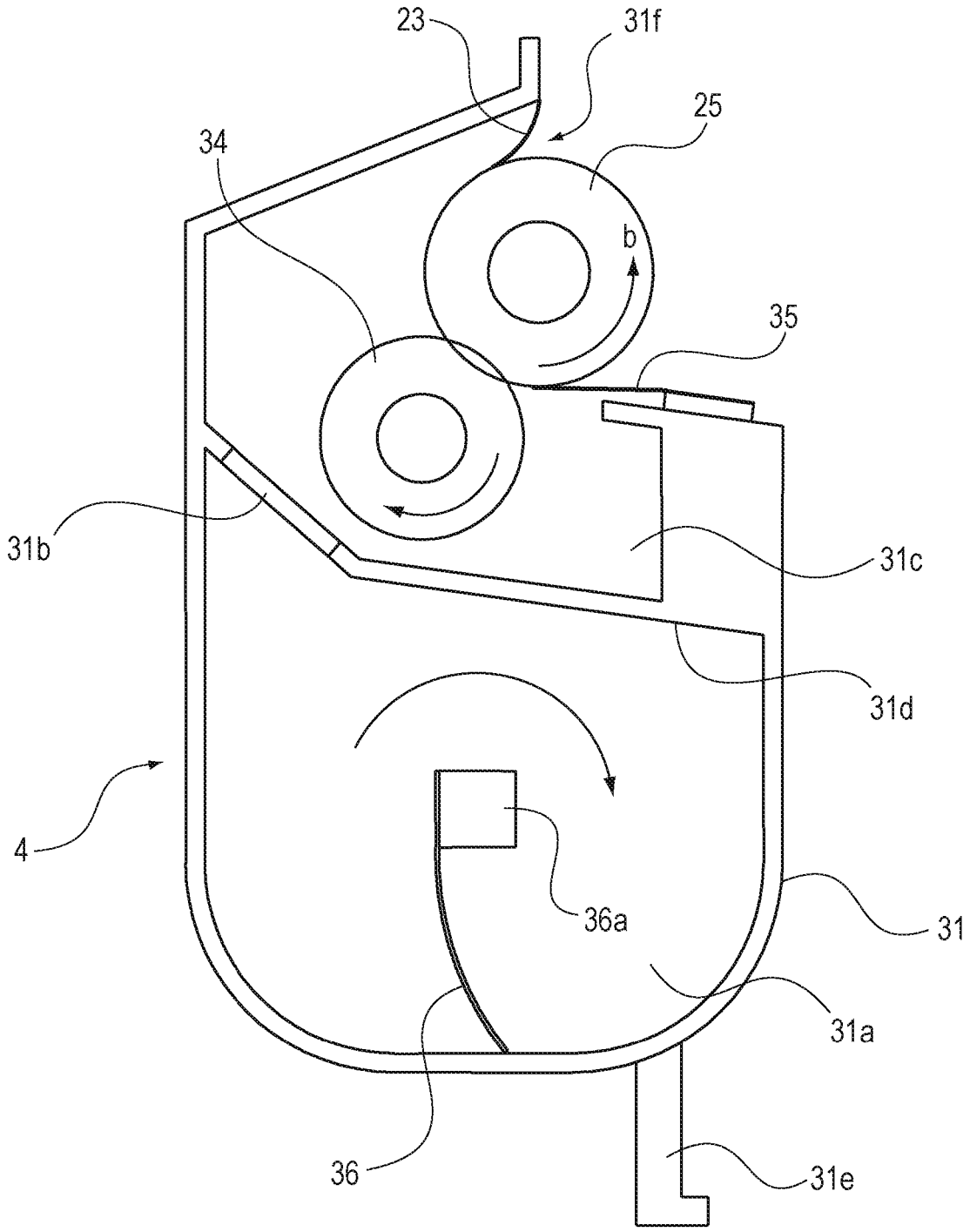
FIG. 5 is a cross-sectional view illustrating an example configuration of the developing cartridge.

As illustrated in FIG. 4, each drum cartridge 9 forming a process cartridge includes a photosensitive drum 1 serving as an image bearing member and formed by an electrophotographic photosensitive member. The drum cartridge 9 further includes a charging roller 2 (charging roller 2*a*, 2*b*, 2*c*, or 2*d* in FIG. 1) serving as a charging unit and disposed adjacent to the photosensitive drum 1. The drum cartridge 9 further includes a cleaning member 6 (cleaning member 6*a*, 6*b*, 6*c*, or 6*d* in FIG. 1) serving as a cleaning unit. Image formation processing units, such as the photosensitive drum 1, the charging roller 2, and the cleaning member 6, are integrally provided in the drum cartridge 9. As illustrated in FIG. 5, image formation processing units, such as a developing roller 25 (developing roller 25*a*, 25*b*, 25*c*, or 25*d* in FIG. 1) serving as a developer bearing member and a developing blade 35 (developing blade 35*a*, 35*b*, 35*c*, or 35*d* in FIG. 1), are integrally disposed in each developing cartridge 4.

The charging roller 2 uniformly charges the surface of the photosensitive drum 1 rotating in the clockwise direction in FIG. 1. A scanner unit 3 serving as an image exposure unit is disposed below the drum cartridges 9 and the developing cartridges 4 illustrated in FIG. 1. The scanner unit 3 selectively exposes the surface of each photosensitive drum 1 to light to form an electrostatic latent image on the surface of the photosensitive drum 1. The developing roller 25 supplies a developer (toner) to the electrostatic latent image on the surface of the photosensitive drum 1 to develop and visualize the electrostatic latent image into a toner image.

A feeding cassette 17 holding recording materials S therein is detachably mounted in the lower part of the image forming apparatus 100 illustrated in FIG. 1. The recording materials S in the feeding cassette 17 are separately fed one by one by the cooperation of a feeding roller 54 and a separation pad 19. The recording material S fed by the feeding roller 54 is conveyed by conveying rollers 76 and brought into contact, at the leading edge thereof, with the nip between registration rollers 55 temporarily stopped. A skew of the recording material S is corrected by stiffness of the recording material S.

An intermediate transfer unit 5 where the toner image on the surface of each photosensitive drum 1 is primary-transferred is disposed above the drum cartridges 9 and the developing cartridges 4. The intermediate transfer unit 5 includes an intermediate transfer belt 14 which is stretched in such a way that it can be moved by a driving roller 56, a driven roller 57, and an inner secondary-transfer roller 59 in the counterclockwise direction in FIG. 1.

The inner periphery of the intermediate transfer belt 14 is provided with primary transfer rollers 58*a*, 58*b*, 58*c*, and 58*d* (which may hereinafter be referred to as "primary transfer rollers 58"), each serving as a primary transfer unit. The primary transfer rollers 58 are arranged to face the respective surfaces of the photosensitive drums 1 for different colors, with the intermediate transfer belt 14 interposed therebetween. An outer secondary-transfer roller 69 serving as a secondary transfer unit is disposed opposite the inner secondary-transfer roller 59, with the intermediate transfer belt 14 interposed therebetween.

The outer periphery of the intermediate transfer belt 14 is in contact with the surface of each photosensitive drum 1 and is moved in the counterclockwise direction in FIG. 1. By applying a primary transfer voltage to each of the primary transfer rollers 58, the toner images formed on the respective surfaces of the photosensitive drums 1 are sequentially primary-transferred to and superimposed on the outer periphery of the intermediate transfer belt 14.

The recording material S is conveyed at predetermined timing by the registration rollers 55 to a secondary transfer nip between the outer periphery of the intermediate transfer belt 14 and the outer secondary-transfer roller 69. Then, a predetermined secondary transfer voltage is applied to the inner secondary-transfer roller 59 disposed on the inner periphery of the intermediate transfer belt 14. Additionally, a predetermined secondary transfer voltage is applied to the outer secondary-transfer roller 69 disposed on the outer periphery of the intermediate transfer belt 14. The toner image on the outer periphery of the intermediate transfer belt 14 is thus secondary-transferred onto the recording material S.

The recording material S onto which the toner image has been secondary-transferred at the secondary transfer nip between the outer periphery of the intermediate transfer belt 14 and the outer secondary-transfer roller 69 is conveyed to a fixing device 74 serving as a fixing unit. The fixing device 74 is disposed in the upper part of the image forming apparatus 100 illustrated in FIG. 1. After the toner image is thermally fixed on the recording material S by the fixing device 74, the recording material S is discharged by discharge rollers 72 to an output unit 75.

(Image Forming Operation)

An image forming operation performed by the image forming apparatus 100 illustrated in FIG. 1 will now be described. First, each photosensitive drum 1 is rotated in the clockwise direction in FIG. 1, and the surface of the photosensitive drum 1 is uniformly charged by the corresponding charging roller 2. Then, the uniformly charged surface of the photosensitive drum 1 is selectively exposed to laser light which is emitted from the scanner unit 3 in accordance with image information. Electrostatic latent images are thus formed on the respective surfaces of the photosensitive drums 1. The developing roller 25 in the developing device 15 for each color supplies a developer (toner) to the electrostatic latent image on the surface of the corresponding photosensitive drum 1 to develop the electrostatic latent image into a toner image. Toner images of different colors are thus formed on the respective surfaces of the photosensitive drums 1.

In synchronization with formation of the toner images of different colors on the respective surfaces of the photosensitive drums 1, the recording material S is conveyed by the registration rollers 55 to the secondary transfer nip at which the inner secondary-transfer roller 59 and the outer secondary-transfer roller 69 are in contact with each other, with the intermediate transfer belt 14 interposed therebetween. Then, by applying a secondary-transfer bias voltage to the outer secondary-transfer roller 69, the toner images on the outer periphery of the intermediate transfer belt 14 are secondary-transferred onto the recording material S.

The recording material S having the resulting toner image thereon is subjected to heat and pressure while being sandwiched and conveyed between a fixing roller and a pressure roller in the fixing device 74. The toner image on the recording material S is thus thermally fused and fixed on the recording material S. Then, the recording material S is conveyed while being sandwiched between the discharge rollers 72 and discharged to the output unit 75.

After the toner image formed on the surface of each photosensitive drum 1 is primary-transferred onto the intermediate transfer belt 14, residual toner remaining on the surface of the photosensitive drum 1 is scraped off and removed by the cleaning member 6. After the toner images primary-transferred onto the outer periphery of the intermediate transfer belt 14 are secondary-transferred onto the recording material S, residual toner remaining on the outer periphery of the intermediate transfer belt 14 is scraped off and removed by a cleaning member 26 serving as a cleaning unit.

(Drum Cartridge)

Figure 3:
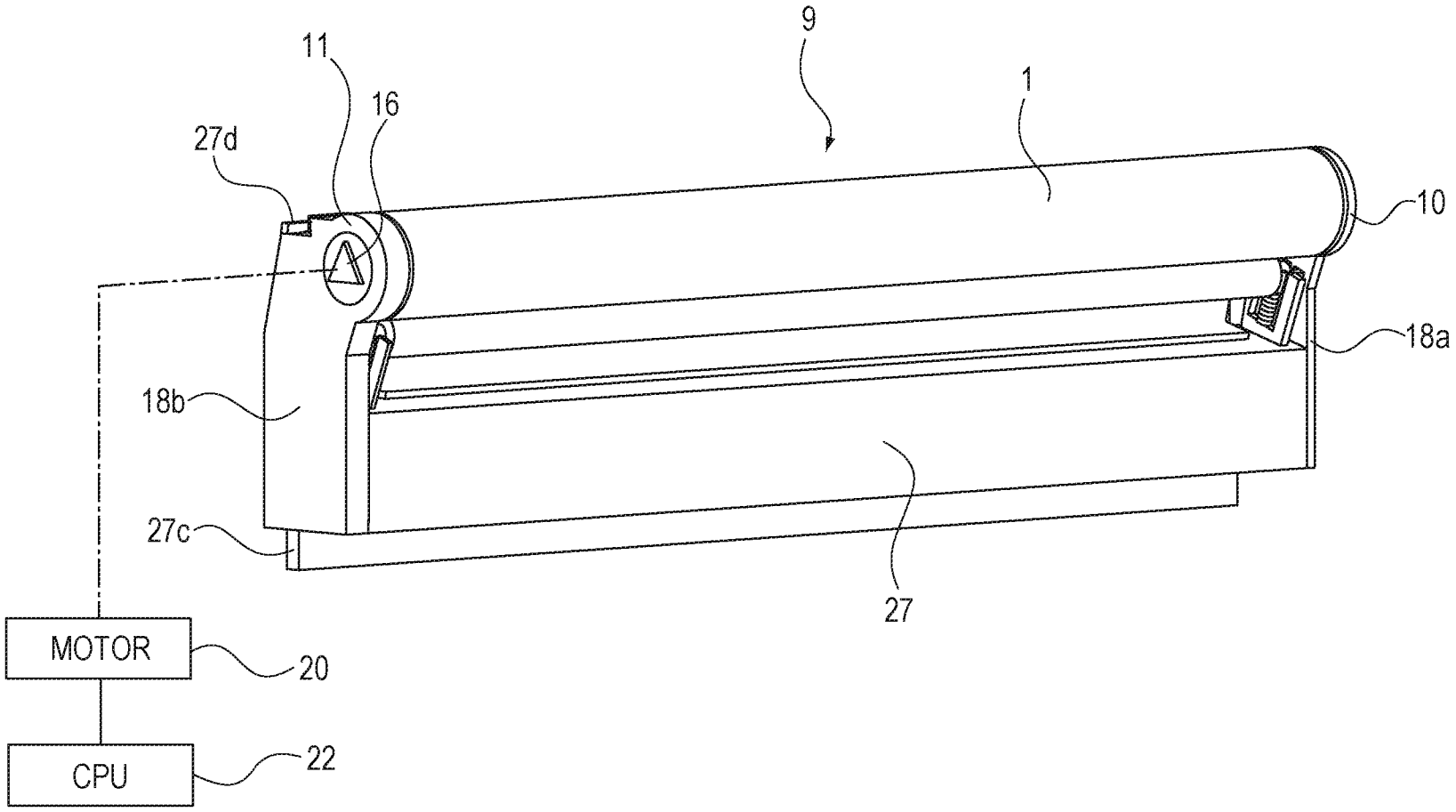
FIG. 3 is a perspective view illustrating an example configuration of the drum cartridge.

An example configuration of the drum cartridge 9, which is a cartridge according to an embodiment of the disclosure, will now be described with reference to FIGS. 3 and 4. FIG. 3 is a perspective view illustrating a configuration of the drum cartridge 9, and FIG. 4 is a cross-sectional view illustrating the configuration of the drum cartridge 9. Note that the drum cartridges 9Y, 9M, 9C, and 9K illustrated in FIGS. 1 and 2 have the same configuration.

In the present embodiment, in the insertion direction of the drum cartridge 9 and the developing cartridge 4 indicated by arrow F in FIG. 2, the upstream side in the insertion direction (i.e., front side in FIG. 2) will be referred to as a front side of the image forming apparatus 100, and the downstream side in the insertion direction (i.e., back side in FIG. 2) will be referred to as a back side of the image forming apparatus 100.

As illustrated in FIG. 3, in the cleaning frame 27 of the drum cartridge 9, the photosensitive drum 1 is rotatably supported by bearings 10 and 11 in respective flanges 18*a* and 18*b*. The photosensitive drum 1 is provided with a drum coupling 16 on the side of the bearing 11, which is at one end in the longitudinal direction (axis direction) of the photosensitive drum 1. A rotational driving force from a motor 20 (see FIG. 3), serving as a driving source, is transmitted to the drum coupling 16.

As illustrated in FIG. 4, the charging roller 2 and the cleaning member 6 are disposed around the photosensitive drum 1. The cleaning member 6 is composed of an elastic member 7 formed by a rubber blade and a supporting member 8. An end portion 7*a* of the elastic member 7 is brought into contact with the surface of the photosensitive drum 1 toward a counter facing the end portion 7*a* across the rotation direction of the photosensitive drum 1 indicated by arrow a in FIG. 4.

Thus, residual toner remaining on the surface of the photosensitive drum 1 after primary transfer is scraped off and removed by the end portion 7*a* of the elastic member 7. The residual toner removed from the surface of the photosensitive drum 1 by the cleaning member 6 drops into a removed toner chamber 27*a* formed by the cleaning frame 27.

The cleaning frame 27 has an opening 27*b* that exposes part of the surface of the photosensitive drum 1 to the outside. To prevent the removed toner in the removed toner chamber 27*a* from leaking out through the opening 27*b*, one edge of a scooping sheet 21, which is supported at the other edge thereof by the cleaning frame 27, comes into contact with the surface of the photosensitive drum 1.

The rotational driving force of the motor 20 (see FIG. 3), serving as a driving source, is transmitted through the drum coupling 16 to the photosensitive drum 1 rotatably disposed in the drum cartridge 9 illustrated in FIG. 3. A central processing unit (CPU) 22, serving as a control unit, controls the motor 20 in accordance with the image forming operation to rotationally drive the photosensitive drum 1. The charging roller 2 is rotatably attached to the drum cartridge 9 with a bearing 28 (see FIG. 4) interposed therebetween. The charging roller 2 is pressed by a pressure member 33 against the surface of the photosensitive drum 1, and is rotated by the rotation of the photosensitive drum 1.

(Developing Cartridge)

An example configuration of the developing cartridge 4 will now be described with reference to FIG. 5. FIG. 5 is a cross-sectional view illustrating a configuration of the developing cartridge 4. Toner serving as a developer is contained in a toner containing chamber 31*a* formed by the developing frame 31 of the developing cartridge 4 illustrated in FIG. 5.

A yellow toner, a magenta toner, a cyan toner, and a black toner are contained in the developing cartridge 4Y, the developing cartridge 4M, the developing cartridge 4C, and the developing cartridge 4K, respectively, illustrated in FIGS. 1 and 2. The developing cartridges 4 have the same configuration except that they contain toners of different colors.

In a developing chamber 31*c* formed by the developing frame 31 of the developing cartridge 4, the developing roller 25 that rotates in the direction of arrow b in FIG. 5 while being in contact with the surface of the photosensitive drum 1 is rotatably supported. Also in the developing chamber 31*c*, a supply roller 34 that rotates while being in contact with the surface of the developing roller 25 is rotatably supported. Additionally, the developing blade 35 that regulates the thickness of the toner layer on the surface of the developing roller 25 is supported by the developing frame 31.

The toner containing chamber 31*a* and the developing chamber 31*c* are separated by a partition wall 31*d*, which has an opening 31*b* passing therethrough. The toner containing chamber 31*a* and the developing chamber 31*c* communicate with each other through the opening 31*b*. In the toner containing chamber 31*a*, a conveying member 36 that stirs and conveys the toner contained in the toner containing chamber 31*a* is rotatably supported.

The toner contained in the toner containing chamber 31*a* is stirred by the conveying member 36 rotating about a rotation shaft 36*a* in the clockwise direction in FIG. 5, and is conveyed through the opening 31*b* into the developing chamber 31*c*. Then, the toner is supplied by the supply roller 34 rotating in the clockwise direction in FIG. 5 onto the surface of the developing roller 25. The thickness of the toner layer on the surface of the developing roller 25 is regulated by the developing blade 35.

The developing chamber 31*c* has an opening 31*f* that exposes part of the surface of the developing roller 25 to the outside. To prevent the toner in the developing chamber 31*c* from leaking out through the opening 31*f*, one edge of a seal member 23, which is supported at the other edge thereof by the developing frame 31, comes into contact with the surface of the developing roller 25. In the rotation direction of the developing roller 25 indicated by arrow b in FIG. 5, the seal member 23 is disposed downstream of a developing position where the developing roller 25 and the photosensitive drum 1 face each other, whereas the developing blade 35 is disposed upstream of the developing position.

The developing frame 31 has a biased portion 31*e* biased by a biasing member (not shown) in the main body of the image forming apparatus 100. Additionally, the developing frame 31 has a back developing bearing (not shown) and a front developing bearing (not shown) on both sides of each of the developing roller 25 and the supply roller 34 in the longitudinal direction (axis direction). With the back developing bearing and the front developing bearing described above, the developing roller 25 and the supply roller 34 are each rotatably supported by the developing frame 31.

(Mounting of Drum Cartridge and Developing Cartridge)

An example configuration for inserting and mounting the drum cartridge 9 and the developing cartridge 4 to the main body of the image forming apparatus 100 will now be described with reference to FIG. 2. As illustrated in FIG. 2, the drum cartridge 9 and the developing cartridge 4 are inserted into the corresponding opening 101 in the main body of the image forming apparatus 100. Specifically, the drum cartridge 9 and the developing cartridge 4 are inserted from the front side of the image forming apparatus 100 (i.e., front side in FIG. 2) toward the back side of the image forming apparatus 100 (i.e., back side in FIG. 2) in the direction parallel to the longitudinal direction (axis direction) of the photosensitive drum 1 indicated by arrow F in FIG. 2.

In the present embodiment, the upstream side in the insertion direction of the drum cartridge 9 and the developing cartridge 4 indicated by arrow F in FIG. 2 will be referred to as a front side of the image forming apparatus 100 (i.e., front side in FIG. 2), and the downstream side in the insertion direction will be referred to as a back side of the image forming apparatus 100 (i.e., back side in FIG. 2).

As illustrated in FIG. 2, the upper guide 103 U-shaped in cross-section and serving as a first guide corresponding to each drum cartridge 9 is disposed on the upper right side in the corresponding opening 101 in the main body of the image forming apparatus 100, and the lower guide 102 U-shaped in cross-section and serving as a second guide corresponding to the drum cartridge 9 is disposed on the lower right side in the opening 101. The upper guide 103 and the lower guide 102 are each formed by a rail member U-shaped in cross-section and extending along the insertion direction of the drum cartridge 9 indicated by arrow F in FIG. 2.

Similarly, the upper guide 105 U-shaped in cross-section and serving as a third guide corresponding to each developing cartridge 4 is disposed on the upper left side in the corresponding opening 101 in the main body of the image forming apparatus 100, and the lower guide 104 U-shaped in cross-section and serving as a fourth guide corresponding to the developing cartridge 4 is disposed on the lower left side in the opening 101. The upper guide 105 and the lower guide 104 are each formed by a rail member U-shaped in cross-section and extending along the insertion direction of the developing cartridge 4 indicated by arrow F in FIG. 2.

(Drum Protection Configuration)

Figure 6B:
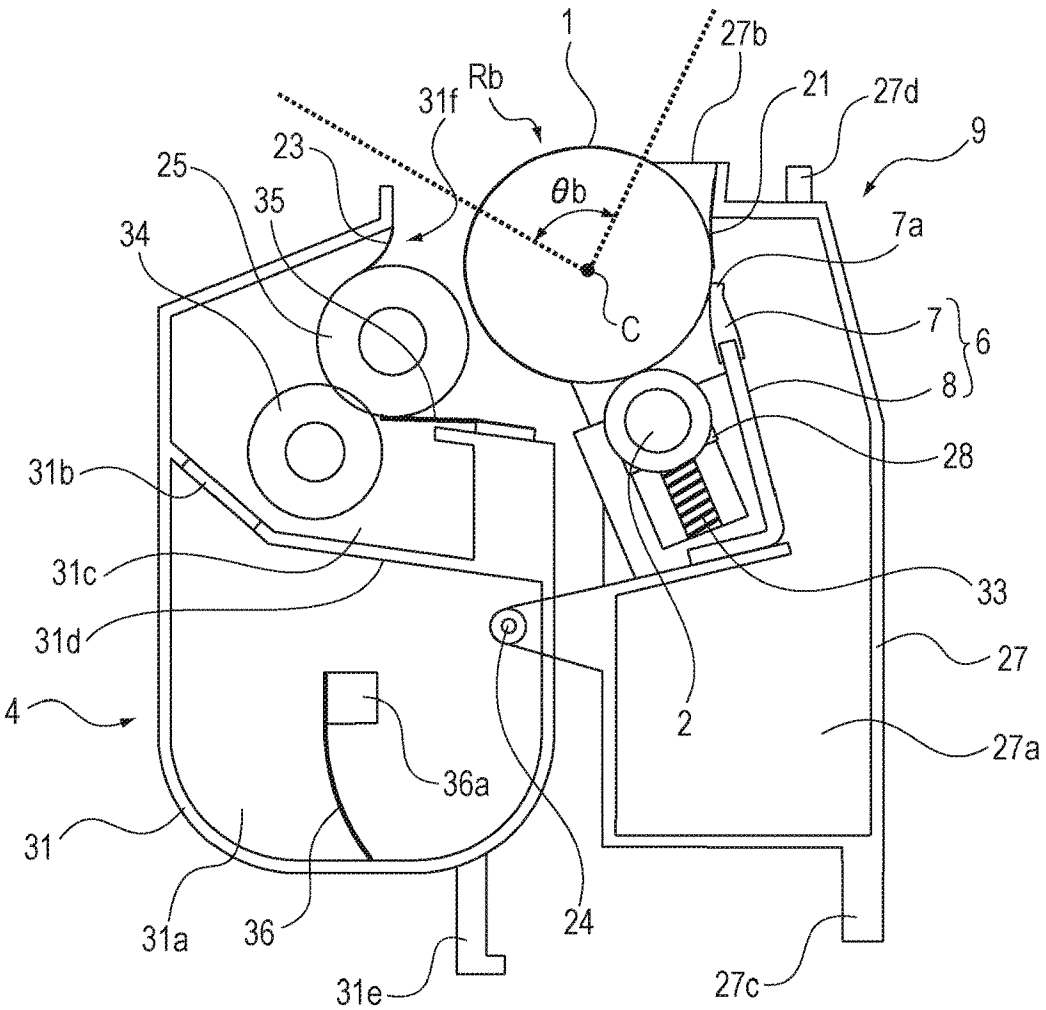
FIG. 6B is a cross-sectional view illustrating an exposed region of the surface of the photosensitive drum when the drum cartridge and the developing cartridge are coupled to form an integral unit in such a way that they can turn about a turning shaft.
Figure 6A:
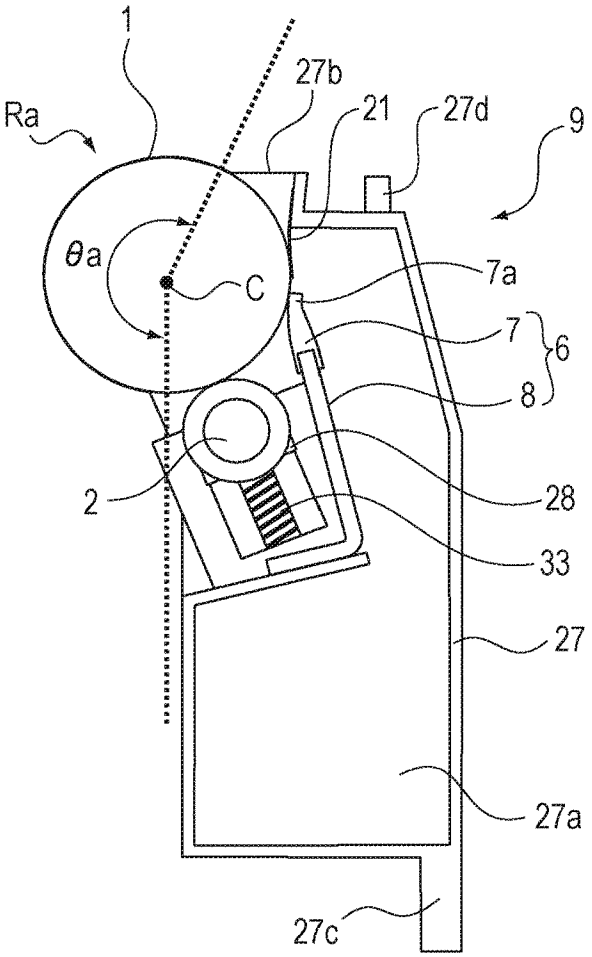
FIG. 6A is a cross-sectional view illustrating an exposed region of the surface of a photosensitive drum when the drum cartridge and the developing cartridge are configured as separate components.

An example configuration for warning the user not to touch the surface of the photosensitive drum 1, which is a feature of the disclosure, will now be described with reference to FIGS. 6A and 6B, FIG. 7, and FIG. 8. FIG. 6A is a cross-sectional view illustrating an exposed region of the surface of the photosensitive drum 1 when the drum cartridge 9 and the developing cartridge 4 are configured as separate components. FIG. 6B is a cross-sectional view illustrating an exposed region of the surface of the photosensitive drum 1 when the drum cartridge 9 and the developing cartridge 4 are coupled to form an integral unit in such a way that they can turn about a turning shaft 24. FIGS. 6A and 6B are cross-sectional views of the drum cartridge 9 and the developing cartridge 4 as viewed in the direction of the rotation axis of the photosensitive drum 1.

Figure 7:
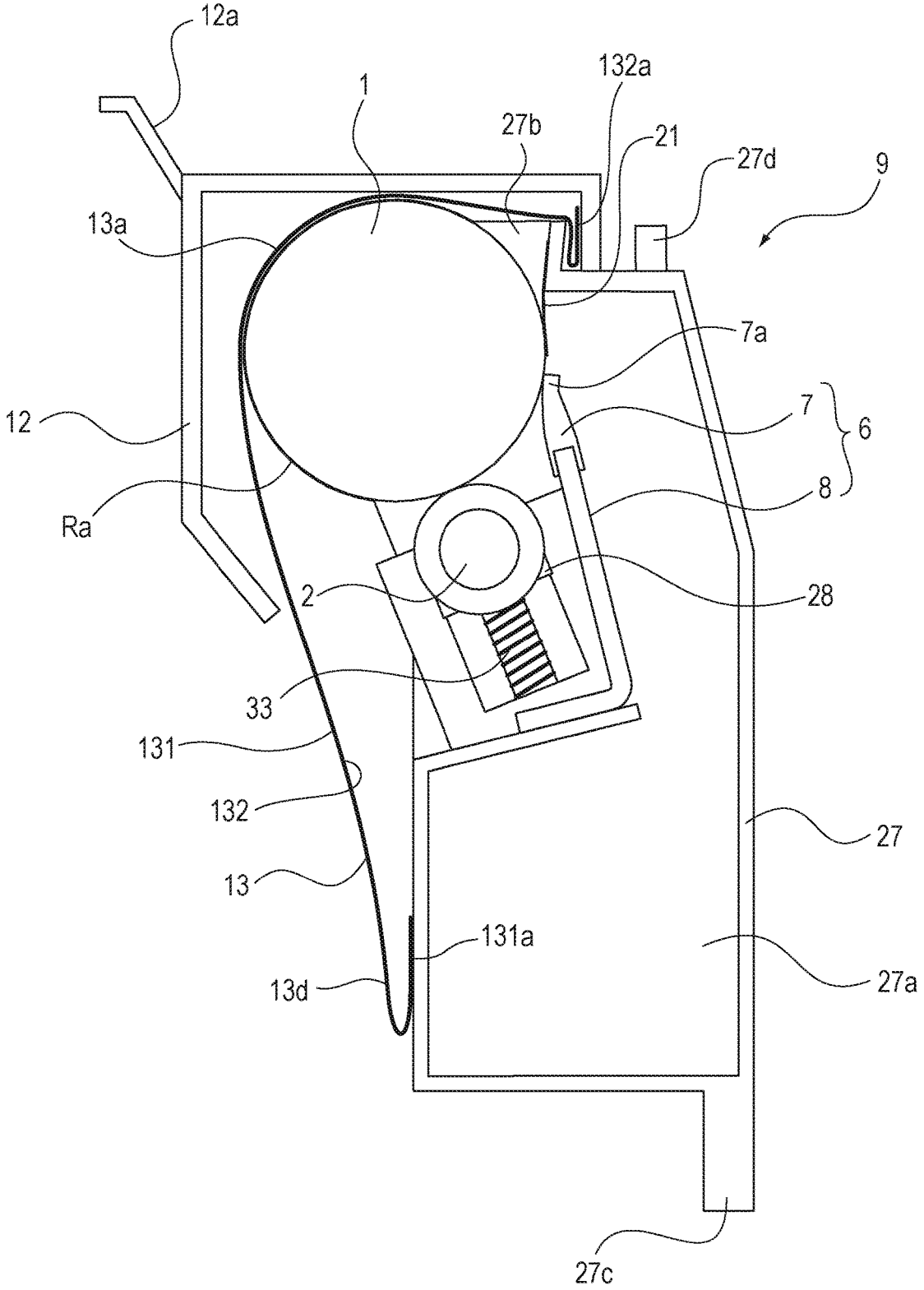
FIG. 7 is a cross-sectional view illustrating an example configuration of a drum cover detachably factory-mounted on a cleaning frame of the drum cartridge.
Figure 8:
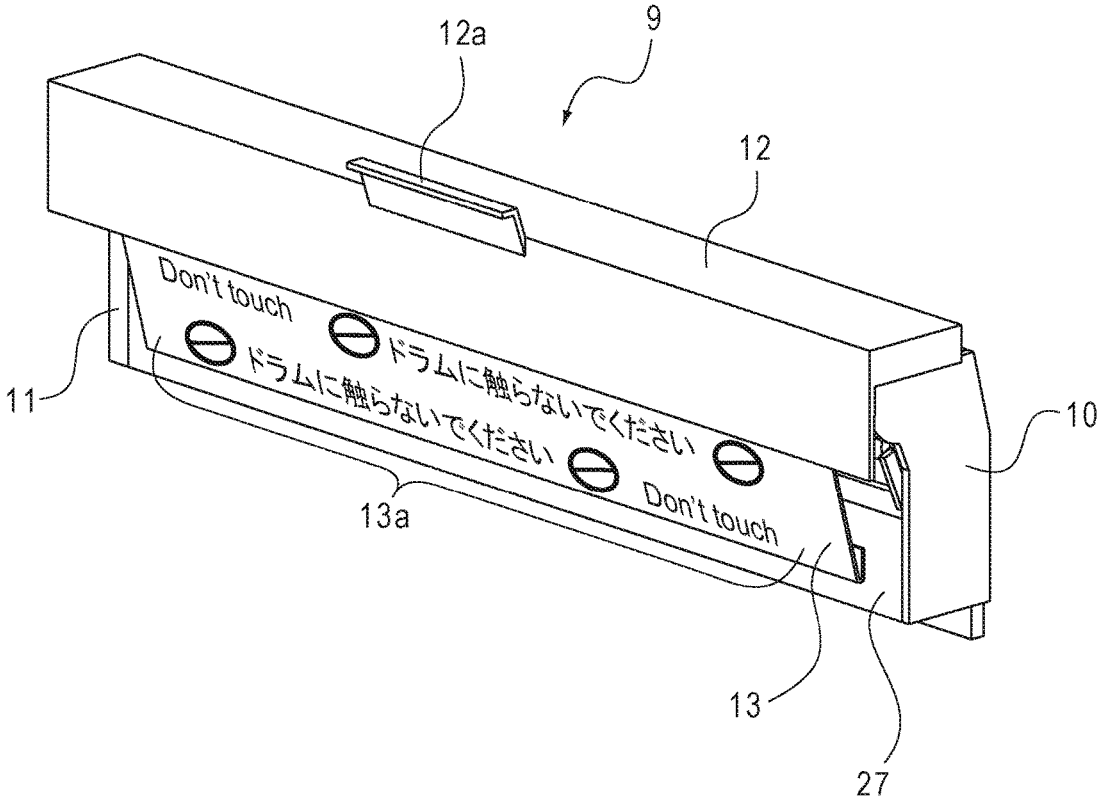
FIG. 8 is a perspective view of the drum cartridge including the drum cover and the sheet member attached in place.

FIG. 7 is a cross-sectional view illustrating an example configuration of a drum cover 12 and a sheet member 13 detachably factory-mounted on the cleaning frame 27 of the drum cartridge 9. FIG. 8 is a perspective view illustrating how handling caution information 13*a*, which is contact prohibiting information warning the user not to touch the surface of the photosensitive drum 1, is written on the sheet member 13.

As illustrated in FIG. 6A, the surface of the photosensitive drum 1 is significantly exposed from the opening 27*b* in the drum cartridge 9 when the drum cartridge 9 and the developing cartridge 4 are configured as separate components. Therefore, when, as in FIG. 2, the user holds the drum cartridge 9 and attaches or detaches it to or from the main body of the image forming apparatus 100, the user may touch the surface of the photosensitive drum 1 significantly exposed from the opening 27*b*.

As illustrated in FIGS. 6A and 6B, the photosensitive drum 1 is a cylindrical member. Regions Ra and Rb of the surface of the photosensitive drum 1 are exposed from the openings 27*b* and 31*f*, respectively, to the outside and can be touched by the user. The size of each of the regions Ra and Rb is expressed by a central angle θ of a circular sector centered at a rotation center C of the photosensitive drum 1.

That is, the region of the central angle θ is a region having an arc corresponding to the central angle θ, as viewed in the direction of the rotation axis of the photosensitive drum 1. The central angle θ of the circular sector corresponding to the region Ra when the drum cartridge 9 and the developing cartridge 4 are configured as separate components (see FIG. 6A) is denoted by θa. The central angle θ of the circular sector corresponding to the region Rb when the drum cartridge 9 and the developing cartridge 4 are configured as an integral unit (see FIG. 6B) is denoted by θb. The central angles θa and θb satisfy the relation θa>θb.

When, as in FIG. 2, the user holds the drum cartridge 9 and attaches or detaches it to or from the main body of the image forming apparatus 100, if the user touches the surface of the photosensitive drum 1 exposed from the opening 27*b*, the adhesion of finger oil or the like to the surface of the photosensitive drum 1 may affect image quality. In particular, if the central angle θa corresponding to the region Ra of the surface of the photosensitive drum 1 that can be touched by the user is 180° or more (i.e., if the area of the region Ra is greater than or equal to half the area of the entire outer periphery of the cylindrical photosensitive drum 1), the user is more likely to accidentally touch the surface of the photosensitive drum 1. As illustrated in FIG. 6A, the region Ra of the photosensitive drum 1 exposed from the opening 27*b* is a region having an arc corresponding to the central angle θa, as viewed in the direction of the rotation axis of the photosensitive drum 1, and the central angle θa is greater than 180°.

As illustrated in FIG. 7, to prevent the user from touching the surface of the photosensitive drum 1, the drum cover 12 serving as a cover member that covers the surface of the photosensitive drum 1 is detachably mounted on the cleaning frame 27 of the drum cartridge 9 in a factory default state. The drum cover 12 illustrated in FIG. 7 has the function of protecting the surface of the photosensitive drum 1 from light, dust, and user's touch.

The drum cover 12 attached to the cleaning frame 27 covers at least part of the region Ra of the photosensitive drum 1 exposed from the opening 27*b*. At least part of the region Ra of the photosensitive drum 1 exposed from the opening 27*b* is a region exposed from the opening 27*b* when the drum cover 12 (cover member) is off the cleaning frame 27 (frame). Therefore, after shipment of the drum cartridge 9 from the factory, the surface of the photosensitive drum 1 can be protected until the user removes the drum cover 12 from the cleaning frame 27 of the drum cartridge 9.

After removing the drum cover 12 from the cleaning frame 27 of the drum cartridge 9, the user holds the drum cartridge 9 and inserts and mounts it through the opening 101 in the main body of the image forming apparatus 100 as in FIG. 2. When the user holds the drum cartridge 9 and inserts and mounts it through the opening 101 in the main body of the image forming apparatus 100, the surface of the photosensitive drum 1 exposed to the outside from the opening 27*b* in the drum cartridge 9 is not protected by the drum cover 12, as illustrated in FIG. 6A. This means that the user may touch the surface of the photosensitive drum 1.

To reduce the risk of touching during mounting of the drum cartridge 9, the sheet member 13 having flexibility is placed between the cleaning frame 27 and the drum cover 12, as illustrated in FIGS. 7 and 8, to cover the opening 27*b* in the present embodiment. The sheet member 13 has a width across the length of the photosensitive drum 1. The sheet member 13 is secured at one end portion thereof to the drum cover 12, and separably bonded at the other end portion thereof to the cleaning frame 27. By the action of detaching the drum cover 12, the sheet member 13 is separated from the cleaning frame 27 and detached together with the drum cover 12.

Components detached by the user before use of the cartridge often have an orange color. The drum cover 12 in the present embodiment also has an orange color, and the sheet member 13 is a translucent member of a color similar to the drum cover 12. This allows the user to recognize that the sheet member 13 is also to be detached before use of the cartridge, and can indicate to the user that the sheet member 13 and the drum cover 12 are to be detached together.

To separably secure the sheet member 13 to the cleaning frame 27, a multilayer sheet member called "easy-peel film" or the like is used in the present embodiment. For example, the sheet member 13 may be a multilayer sheet which is composed of an exposed outermost layer made of a material thermally compatible with the cleaning frame 27, and a release layer (e.g., cohesive release layer, interlayer release layer, or interfacial release layer) configured to facilitate peeling from the cleaning frame 27.

When heat is applied to the sheet member 13, with the outermost layer thermally compatible with the cleaning frame 27 facing toward the cleaning frame 27, the outermost layer of the sheet member 13 melts and adheres to the cleaning frame 27. Thus, as illustrated in FIG. 7, the sheet member 13 is thermally melted and secured, at a joint portion 131*a* of a first surface 131 thereof, to the cleaning frame 27. Since the sheet member 13 has another layer readily peelable from the cleaning frame 27, the sheet member 13 can be peeled off and easily separated from the cleaning frame 27 by applying a force thereto in a peeling direction. A second surface 132 of the sheet member 13 is opposite the first surface 131 and in contact with the photosensitive drum 1. The second surface 132 has a joint portion 132*a* secured to the drum cover 12.

Figure 9A:
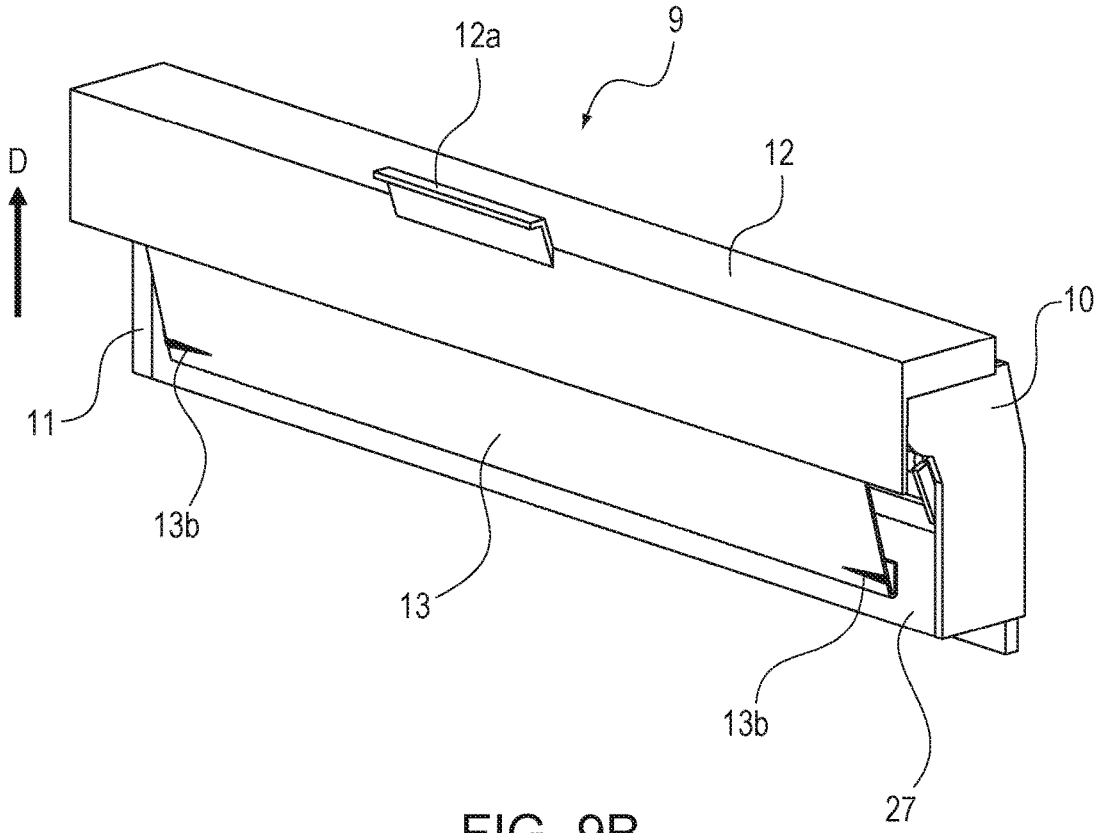
FIGS. 9A and 9B each illustrate an example configuration for separation of the sheet member.
Figure 9B:
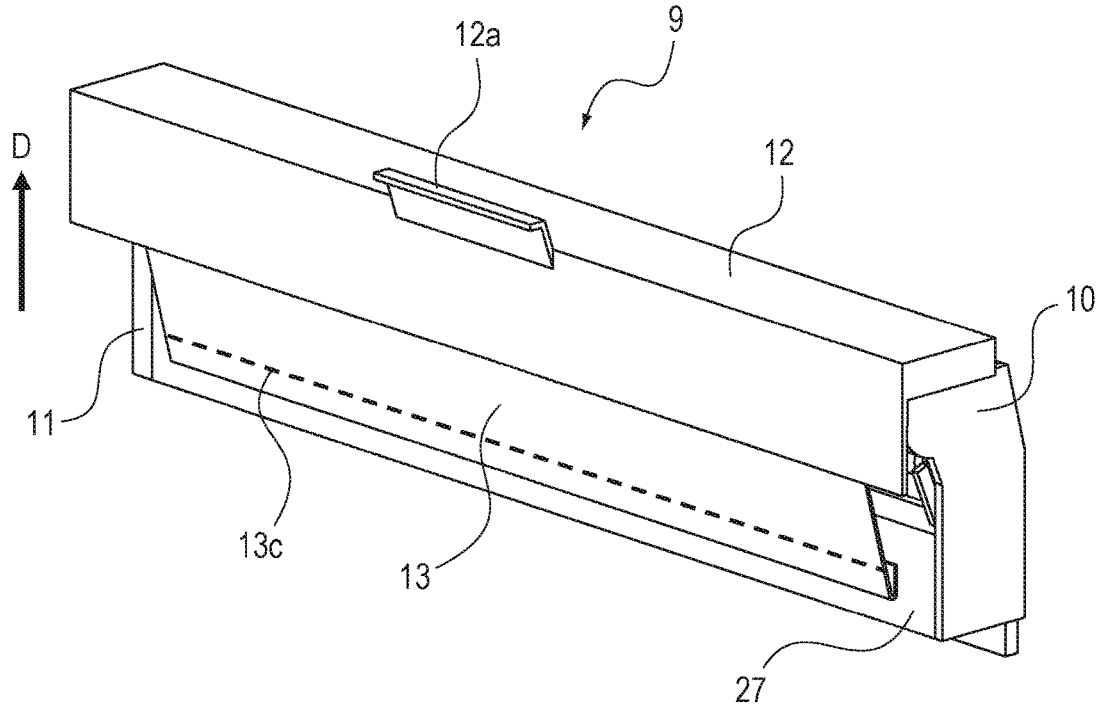

To separably secure the sheet member 13 to the cleaning frame 27, the sheet member 13 may have slits 13*b*, as illustrated in FIG. 9A, in the vicinity of a region where the sheet member 13 is thermally melted and secured to the cleaning frame 27. The slits 13*b* are substantially perpendicular to a detaching direction D (sheet pulling direction) in which the drum cover 12 is detached. In this case, by pulling the sheet member 13 while concentrating stress on the slits 13*b*, the sheet member 13 can be torn and separated from the cleaning frame 27. As illustrated in FIG. 9B, the sheet member 13 may have perforations 13*c*, instead of the slits 13*b*. In this case, the sheet member 13 can be torn along the perforations 13*c* by tension applied to the sheet member 13 during detachment of the drum cover 12. With the slits 13*b* or perforations 13*c*, the sheet member 13 does not require the readily peelable layer described above.

As illustrated in FIG. 8, the handling caution information 13*a* is printed (displayed) on the sheet member 13 which is translucent. The handling caution information 13*a* may include a message for preventing the user from touching the photosensitive drum 1. For example, a message, such as "Don't touch drum (in Japanese)", "Don't touch", "Prohibited from contact", or "Don't touch green roller" (if the photosensitive drum 1 is of green color), that allows the user to recognize that it is undesirable to touch the photosensitive drum 1, is printed on the sheet member 13. The language to be printed is not limited to Japanese or English. The handling caution information 13*a* may be written in multiple languages to alert users in a wide area. An illustration that allows the user to recognize that it is undesirable to touch the photosensitive drum 1, or a symbol that clearly indicates that touching the photosensitive drum 1 is prohibited, may be used to alert the user.

Figure 10A:
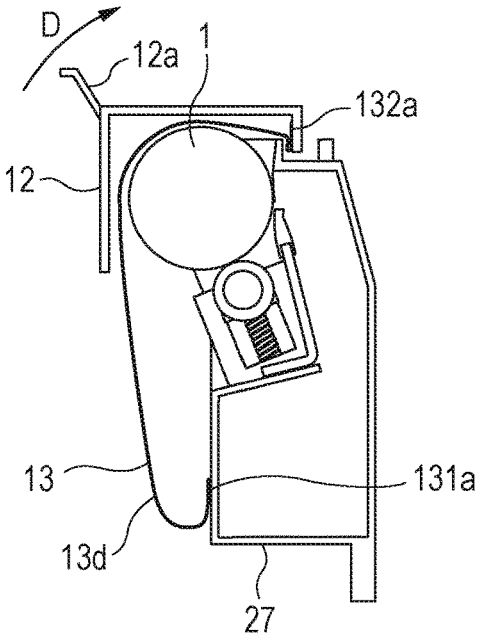
FIGS. 10A to 10C are cross-sectional views illustrating how the drum cover is detached.
Figure 10B:
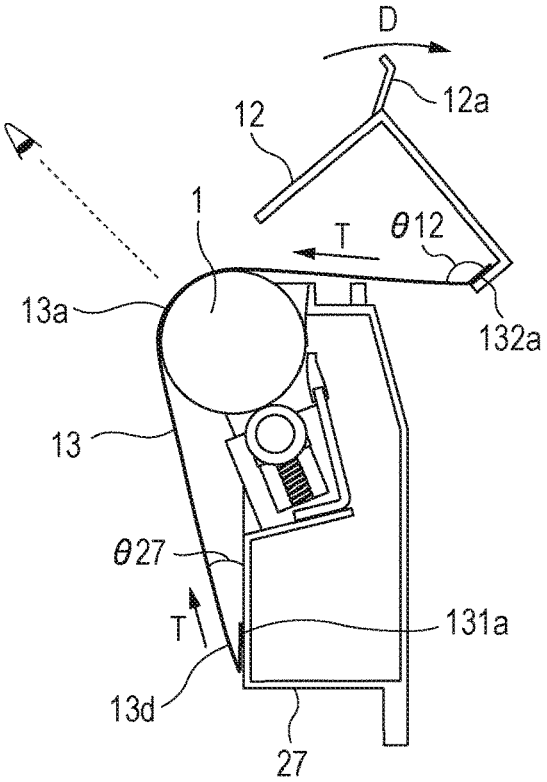
Figure 10C:
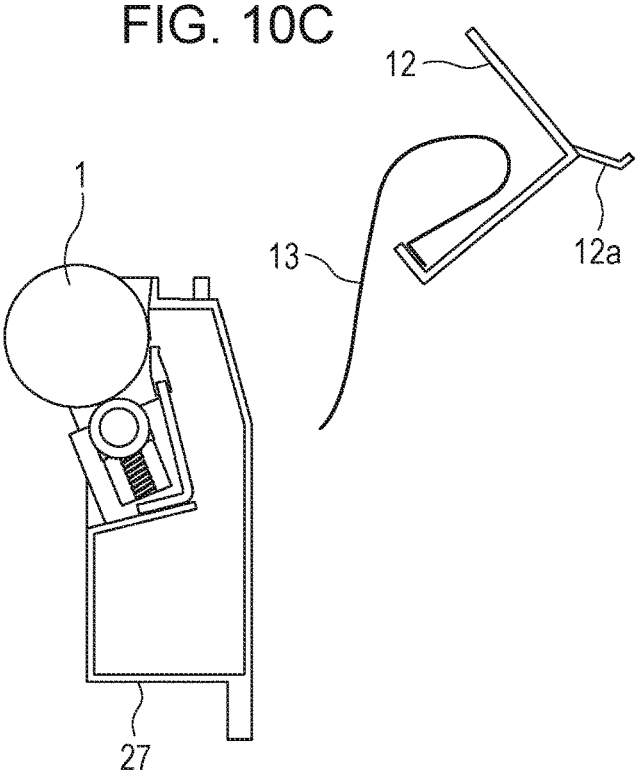

FIGS. 10A, 10B, and 10C illustrate how the sheet member 13 behaves when the drum cover 12 is detached from the cleaning frame 27. FIGS. 10A, 10B, and 10C illustrate a step-by-step process of how the user moves the drum cover 12 in the detaching direction D to detach it from the cleaning frame 27.

As illustrated in FIG. 10A, before use of the drum cartridge 9, the user holds a grip 12*a* on the drum cover 12 attached to the cleaning frame 27 and moves the drum cover 12 in the direction of arrow D to detach it from the cleaning frame 27. As illustrated in FIG. 10B, the action of detaching the drum cover 12 applies tension T to the sheet member 13. At this point, the sheet member 13 is wrapped around the photosensitive drum 1. An angle formed by the direction (or vector) of tension applied between a portion of the sheet member 13 in contact with the photosensitive drum 1 and the joint portion 131*a* of the sheet member 13 joined to the cleaning frame 27, with respect to the joint portion 131*a*, is denoted by θ27. An angle formed by the direction of tension applied to the sheet member 13, with respect to the joint portion 132*a* of the sheet member 13 joined to the drum cover 12, is denoted by θ12. Both end portions of the sheet member 13 individually bonded to the cleaning frame 27 and the drum cover 12 are folded such that the angle θ27 formed on the side of the cleaning frame 27 is an acute angle, and that the angle θ12 formed on the side of the drum cover 12 is an obtuse angle. When the drum cover 12 is attached to the cleaning frame 27 as illustrated in FIGS. 7 and 10A, the sheet member 13 bends to form a portion 13*d* covering the joint portion 131*a*, so that the angle θ27 is an acute angle.

When the angle θ27 formed on the side of the cleaning frame 27 is an acute angle, the tension T acts as a peeling force, which facilitates separation of the sheet member 13 from the cleaning frame 27. When the angle θ12 formed on the side of the drum cover 12 is an obtuse angle, the force required to separate the sheet member 13 from the cleaning frame 27 is smaller than the force required to separate the sheet member 13 from the drum cover 12. Hence, the sheet member 13 can be prevented from being separated from the drum cover 12 before being separated from the cleaning frame 27. That is, as the drum cover 12 separates from the cleaning frame 27, the sheet member 13 is separated from the cleaning frame 27 without being separated from the drum cover 12.

The configuration which allows, during separation of the drum cover 12 from the cleaning frame 27, the sheet member 13 to be separated from the cleaning frame 27 without being separated from the drum cover 12, can be achieved not only by appropriately setting the directions in which the end portions of the sheet member 13 are folded. For example, the number and size of bonding regions where the sheet member 13 is bonded to the cleaning frame 27 by an adhesive, thermal joining, or the like and the adhesive force used here may be made different from those for bonding the sheet member 13 to the drum cover 12. By appropriately setting the numbers and sizes of bonding regions and the adhesive forces described above, the force required to separate the sheet member 13 from the cleaning frame 27 can be made smaller than the force required to separate the sheet member 13 from the drum cover 12. The setting of the numbers and sizes of bonding regions and the adhesive forces described above may be carried out along with the setting of the directions in which the end portions of the sheet member 13 are folded.

The sheet member 13 of the present embodiment is a translucent member as described above. Therefore, in the process of detaching the drum cover 12, the user can see both the photosensitive drum 1 and the sheet member 13 as indicated by a broken line in FIG. 10B. The user can notice the handling caution information 13*a* on the sheet member 13 while seeing the photosensitive drum 1. This allows the user to recognize that the handling caution information 13*a* is about the photosensitive drum 1, and that touching the photosensitive drum 1 is undesirable. It is thus possible to reduce the risk of touching the photosensitive drum 1.

Although the sheet member 13 is a translucent member that allows the photosensitive drum 1 to be seen therethrough in the present embodiment, the sheet member 13 may be a transparent member having the handling caution information 13*a* written thereon.

As described above, in the present embodiment, the transparent or translucent sheet member 13 having the handling caution information 13*a* printed thereon is placed between the drum cover 12 and the cleaning frame 27 of the drum cartridge 9. This allows the user to recognize that touching the photosensitive drum 1 is undesirable. With this configuration, it is possible to provide the user with a cartridge that can reduce the risk of touching the photosensitive drum 1, as compared to the drum cover configuration of the related art.

Without the sheet member 13, the user may touch the photosensitive drum 1 exposed from the opening 27*b* during detachment of the drum cover 12. With the sheet member 13 of the present embodiment, the risk of touching the photosensitive drum 1 during detachment of the drum cover 12 can be reduced.

During detachment of the drum cover 12, the sheet member 13 can be easily separated from the cleaning frame 27 and detached together with the drum cover 12.

(Modifications)

Figure 11:
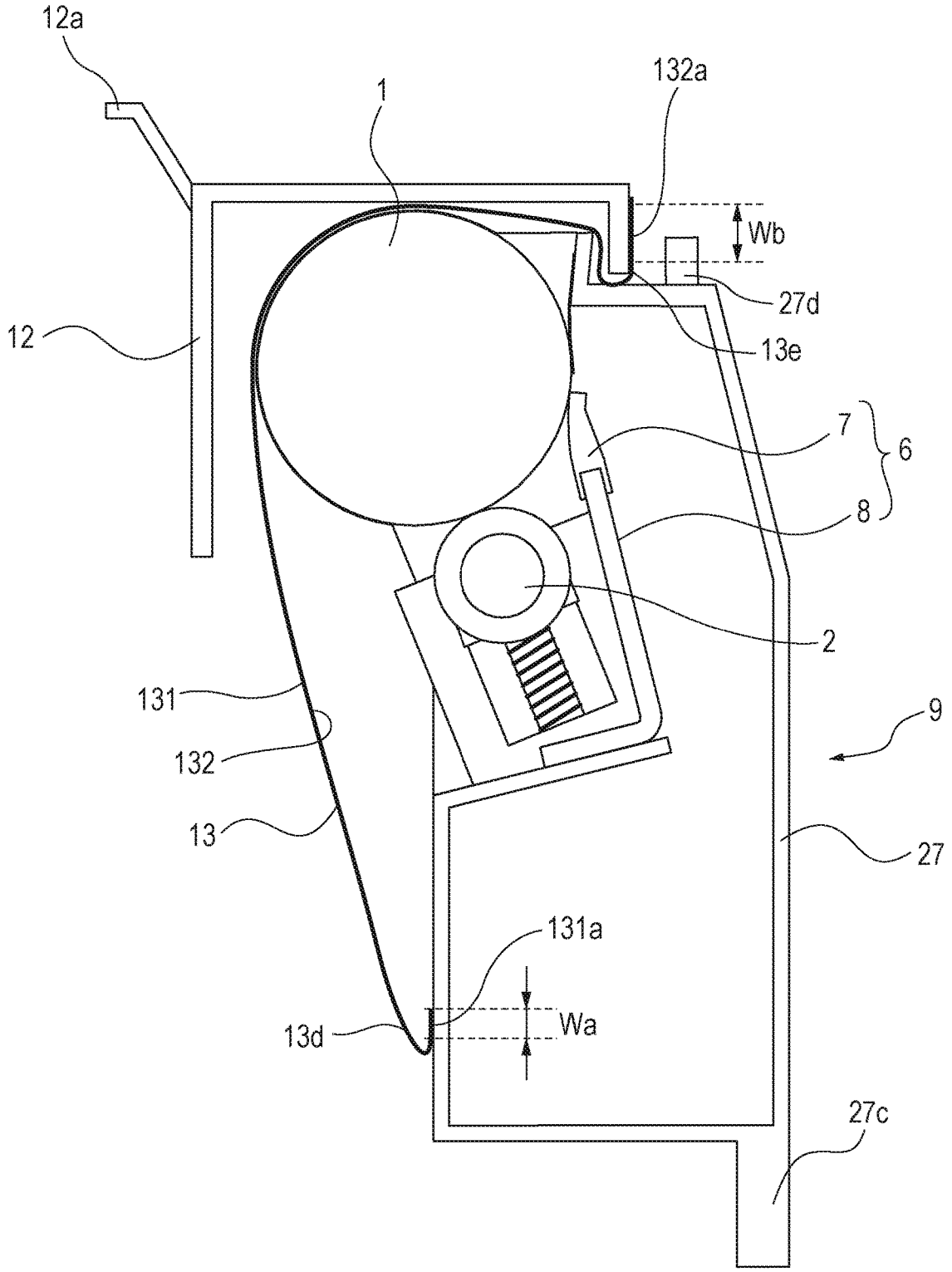
FIG. 11 is a cross-sectional view of the drum cartridge as viewed in the direction of the rotation axis of the photosensitive drum.

Modifications will be described with reference to FIGS. 11 and 12. FIG. 11 is a cross-sectional view of the drum cartridge 9 as viewed in the direction of the rotation axis of the photosensitive drum 1. In the present modification, the area of the joint portion 131*a* of the sheet member 13 joined to the cleaning frame 27 is made different from the area of the joint portion 132*a* of the sheet member 13 joined to the drum cover 12. This can make the force required to separate the sheet member 13 from the cleaning frame 27 smaller than the force required to separate the sheet member 13 from the drum cover 12. Specifically, the joint portion (frame joint portion) 131*a* and the joint portion (cover joint portion) 132*a* have widths Wa and Wb, respectively, as viewed in the direction of the rotation axis of the photosensitive drum 1, and Wa is smaller than Wb. Accordingly, the area of the joint portion 131*a* is smaller than that of the joint portion 132*a*.

As illustrated in FIG. 11, the first surface 131 of the sheet member 13 has the joint portion (cover joint portion) 132*a*. In this case, when tension T is applied to the sheet member 13, a contact portion 13*e* of the sheet member 13 is brought into contact with the drum cover 12. Thus, the angle θ12 formed between the joint portion 132*a* and the direction of the tension T applied to the joint portion 132*a* becomes an obtuse angle.

Figure 12:
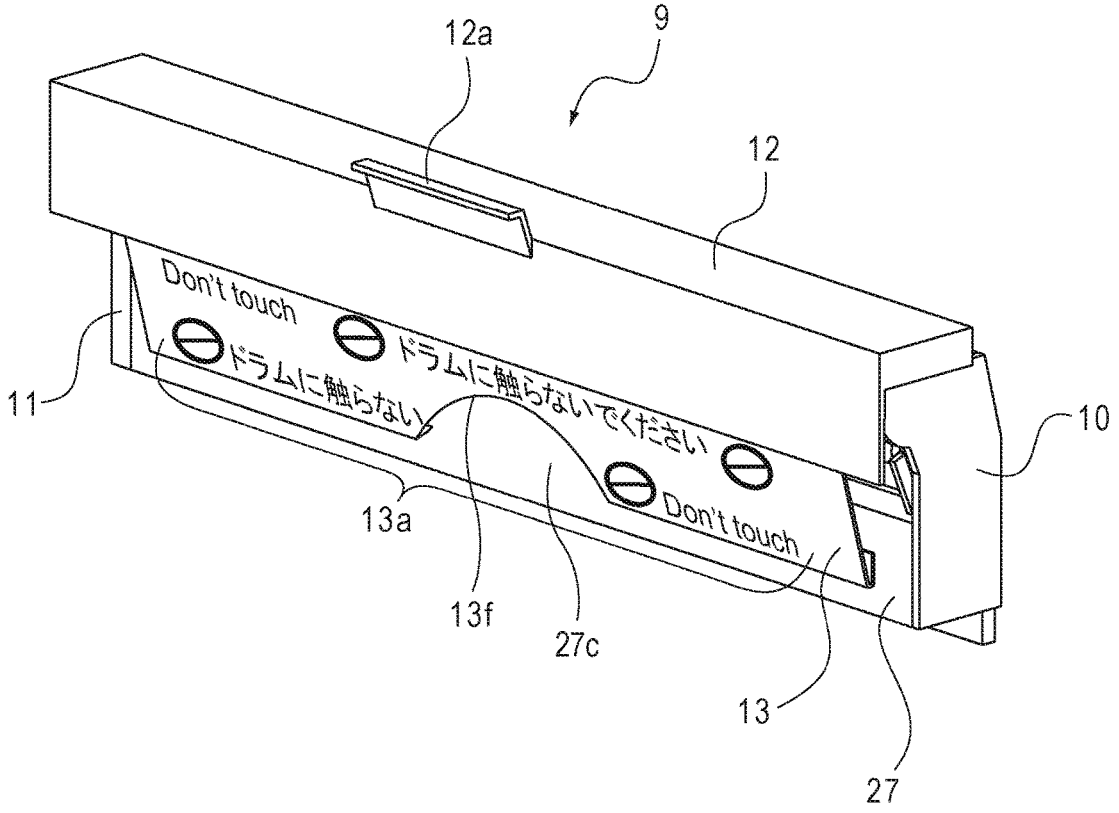
FIG. 12 is a perspective view of the drum cartridge including the drum cover and the sheet member attached in place.

FIG. 12 is a perspective view of the drum cartridge 9 including the drum cover 12 attached in place. As illustrated in FIG. 12, in the present modification, the sheet member 13 has a notch 13*f* on the side of the joint portion 131*a* joined to the cleaning frame 27, and thereby exposes part of the cleaning frame 27. For detaching the drum cover 12, the user generally holds the cleaning frame 27 with one hand and holds the drum cover 12 with the other hand to separate the drum cover 12 and the sheet member 13 from the cleaning frame 27. If the one hand holding the cleaning frame 27 touches the sheet member 13, it may become difficult to detach the sheet member 13 from the cleaning frame 27 and, in some cases, the use may need to reposition the one hand to hold the cleaning frame 27 again. When the sheet member 13 has the notch 13*f*, which exposes a part 27*c* of the cleaning frame 27, the one hand holding the cleaning frame 27 does not easily touch the sheet member 13. It is thus possible to facilitate detachment of the sheet member 13 from the cleaning frame 27, and provide improved usability.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-095013 filed May 11, 2016 and No. 2017-034481 filed Feb. 27, 2017, which are hereby incorporated by reference herein in their entirety.

What is claimed is:

1. A cartridge attachable to and detachable from a main body of an image forming apparatus, the cartridge comprising:

a photosensitive member;

a frame supporting the photosensitive member rotatably and having an opening in which the photosensitive member is exposed;

a cover member removably attached to the frame so as to cover at least part of the opening; and a flexible sheet member on which handling caution information is displayed, a first end portion of the sheet member being attached to the cover member, a second end portion of the sheet member opposite to the first end portion being removably attached to the frame.

2. The cartridge according to claim 1, wherein the sheet member is a transparent or translucent member, which can be placed over the photosensitive member when the cover member is removed from the frame.

3. The cartridge according to claim 1, wherein the sheet member is attached to the frame and the cover member such that when the cover member is removed from the frame, an angle that a direction of tension applied to the sheet member forms with respect to a second attached area of the second end portion of the sheet member attached to the frame is an acute angle and an angle that a direction of tension applied to the sheet member forms with respect to a first attached area of the first end portion of the sheet member attached to the cover member is an obtuse angle.

4. The cartridge according to claim 1, wherein the second end portion of the sheet member is bonded to the frame in a manner such that the sheet member can be peeled from the frame by a release layer thereof.

5. The cartridge according to claim 1, wherein the sheet member has a perforation or slit in the vicinity of an attached area of the second end portion of the sheet member attached to the frame.

6. The cartridge according to claim 2, wherein the handling caution information is contact prohibiting information warning a user not to touch the photosensitive member.

7. The cartridge according to claim 2, wherein the handling caution information is printed in the form of at least one of text, symbol, and illustration.

8. The cartridge according to claim 1, wherein the photosensitive member is a cylindrical member, a region of the photosensitive member, the region being exposed from the opening, is a region having an arc corresponding to a central angle θa as viewed in a direction of a rotation axis of the photosensitive member, and the central angle θa is greater than or equal to 180°.

9. The cartridge according to claim 1, wherein as the cover member is separated from the frame, the sheet member is separated from the frame without being separated from the cover member.

10. The cartridge according to claim 1, wherein the sheet member has a first surface and a second surface opposite the first surface, and wherein a second attached area of the second end portion of the sheet member attached to the frame is provided on the second surface, and a first attached area of the first end portion of the sheet member attached to the cover member is provided on the first surface.

11. The cartridge according to claim 1, wherein the sheet member has a notch configured to expose a part of the frame.

12. A cartridge attachable to and detachable from a main body of an image forming apparatus, the cartridge comprising:

a photosensitive member;

a frame supporting the photosensitive member rotatably and having an opening in which the photosensitive member is exposed;

a cover member removably attached to the frame so as to cover at least part of the opening; and a flexible sheet member, wherein a first end portion of the sheet member is attached to the cover member, and a second end portion of the sheet member opposite to the first end portion is attached to the frame, wherein the second end portion of the sheet member includes an attached area attached to the frame, and the second end portion of the sheet member is bent turning so that a part of the second end portion overlaps the attached area of the second end portion when viewed in a direction orthogonal to a rotation axis of the photosensitive member, the part of the second end portion being arranged closer to the first end portion than the attached area of the second end portion in a direction from the second end portion to the first end portion along the sheet member.

13. The cartridge according to claim 12, wherein the sheet member is a transparent or translucent member, which can be placed over the photosensitive member when the cover member is removed from the frame.

14. The cartridge according to claim 12, wherein in a case where the attached area of the second end portion of the sheet member is a second attached area, the sheet member is attached to the frame and the cover member such that when the cover member is removed from the frame, an angle that a direction of tension applied to the sheet member forms with respect to the second attached area of the second end portion joint portion of the sheet member is an acute angle and an angle that a direction of tension applied to the sheet member forms with respect to a first attached area of the first end portion of the sheet member attached to the cover member is an obtuse angle.

15. The cartridge according to claim 12, wherein the sheet member is bonded to the frame in a manner such that the sheet member can be peeled from the frame by a release layer thereof.

16. The cartridge according to claim 12, wherein the photosensitive member is a cylindrical member, a region of the photosensitive member, the region being exposed from the opening, is a region having an arc corresponding to a central angle θa as viewed in a direction of a rotation axis of the photosensitive member, and the central angle θa is greater than or equal to 180°.

17. The cartridge according to claim 12, wherein as the cover member is separated from the frame, the sheet member is separated from the frame without being separated from the cover member.

18. The cartridge according to claim 12, wherein the sheet member has a first surface and a second surface opposite the first surface, and wherein in a case where the attached area of the second end portion of the sheet member is a second attached area, the second attached area of the second end portion of the sheet member is provided on the second surface, and a first attached area of the first end portion of the sheet member attached to the cover member is provided on the first surface.

19. The cartridge according to claim 1, wherein the second end portion of the sheet member includes an attached area attached to the frame, and the second end portion of the sheet member is bent turning so that a part of the second end portion overlaps the attached area of the second end portion when viewed in a direction orthogonal to a rotation axis of the photosensitive member, the part of the second end portion being arranged closer to the first end portion than the attached area of the second end portion in a direction from the second end portion to the first end portion along the sheet member.

* * * * *